US010562694B2

(12) United States Patent
Austerberry et al.

(10) Patent No.: US 10,562,694 B2
(45) Date of Patent: Feb. 18, 2020

(54) THERMALLY INSULATED CONTAINERS

(71) Applicant: PELI BIOTHERMAL LIMITED, Leighton Buzzard, Bedfordshire (GB)

(72) Inventors: Sean Austerberry, Leighton Buzzard (GB); Richard Wood, Leighton Buzzard (GB); Kevin Valentine, Tring (GB)

(73) Assignee: Peli Biothermal Limited, Bedfordshire (GB)

( * ) Notice: Subject to any disclaimer, the term of this patent is extended or adjusted under 35 U.S.C. 154(b) by 68 days.

(21) Appl. No.: 15/510,272

(22) PCT Filed: Sep. 11, 2015

(86) PCT No.: PCT/GB2015/052628
§ 371 (c)(1),
(2) Date: Mar. 10, 2017

(87) PCT Pub. No.: WO2016/038382
PCT Pub. Date: Mar. 17, 2016

(65) Prior Publication Data

US 2017/0240337 A1 Aug. 24, 2017

(30) Foreign Application Priority Data

Sep. 12, 2014 (GB) ..... 1416159.0

(51) Int. Cl.
*F25D 23/06* (2006.01)
*F25D 3/06* (2006.01)
(Continued)

(52) U.S. Cl.
CPC ..... *B65D 81/3816* (2013.01); *B65D 25/04* (2013.01); *B65D 25/30* (2013.01);
(Continued)

(58) Field of Classification Search
CPC . F25D 2303/08221; F25D 2313/02741; F25D 23/063; F25D 2303/0842;
(Continued)

(56) References Cited

U.S. PATENT DOCUMENTS 1,936,214 A 11/1933 Sommers
2,086,747 A 7/1937 Stetson
(Continued)

FOREIGN PATENT DOCUMENTS

DE 29604325 U1 5/1996
DE 10305550 A1 8/2004
(Continued)

OTHER PUBLICATIONS

Machine English Translation of JP 6439676, Translated Apr. 24, 2019 (Year: 2019).*

*Primary Examiner* — Cassey D Bauer
(74) *Attorney, Agent, or Firm* — Sherrill Law Offices, PLLC

(57) ABSTRACT

A thermal conditioning wall panel (10) for use in a thermally insulating container comprises a panel body (22) having a channel (26) formed therein along one face thereof for receiving one or more thermal conditioning elements (12). At least one foot (32) is formed at the lower end of the body (22) for engagement within a socket provided on the thermally insulating container. The panel further comprises thermal conditioning element retaining elements (40) provided adjacent the longitudinal edges (29) of the channel (26), the retaining elements (40) projecting over a peripheral portion of the channel (26) for retaining the thermal conditioning elements (12) within the channel (26).

44 Claims, 19 Drawing Sheets

(51) Int. Cl.

| | |
|---|---|
| ***B65D 81/38*** | (2006.01) |
| ***B65D 25/04*** | (2006.01) |
| ***B65D 25/30*** | (2006.01) |
| ***B65D 43/16*** | (2006.01) |
| *B65D 19/00* | (2006.01) |

(52) U.S. Cl.
CPC ..... *B65D 43/161* (2013.01); *B65D 81/3818* (2013.01); *F25D 3/06* (2013.01); *F25D 23/06* (2013.01); *B65D 19/0004* (2013.01); *F25D 2303/0843* (2013.01); *F25D 2303/0844* (2013.01); *F25D 2303/08221* (2013.01)

(58) Field of Classification Search
CPC ... F25D 11/006; B65D 2588/74; B65D 83/72; B65D 83/744; B65D 81/3816; B65D 43/161; B65D 25/04; B62D 27/023
See application file for complete search history.

(56) References Cited

U.S. PATENT DOCUMENTS 2,087,966 A * 7/1937 Clark ..... B65D 81/3834 229/103.11
2,728,200 A * 12/1955 Lobl ..... B65D 81/18 229/122.32
2,781,643 A 2/1957 Fairweather
3,070,257 A 12/1962 Bojanowski
3,074,586 A 1/1963 Morrison
3,093,259 A 6/1963 Morrison
3,175,606 A 3/1965 Talmey et al.
3,262,283 A 7/1966 Taylor
3,327,882 A 6/1967 Andrews
3,351,223 A 11/1967 Morrison
3,561,634 A 2/1971 Meldrum
3,982,681 A 9/1976 Graves et al.
4,235,346 A 11/1980 Liggett
4,368,819 A 1/1983 Durham
4,373,633 A 2/1983 Lutz, Sr.
4,619,678 A 10/1986 Rubin
4,630,671 A * 12/1986 Sherman ..... A45C 11/20 165/61
4,845,959 A * 7/1989 Magee ..... B65D 81/3816 62/457.1
4,923,077 A 5/1990 Van Iperen et al.
5,129,519 A 7/1992 David et al.
5,273,801 A 12/1993 Barry et al.
5,361,603 A 11/1994 Merritt-Munson
5,546,758 A 8/1996 Hintermeier
5,669,233 A * 9/1997 Cook ..... B65D 19/06 62/371
5,809,906 A * 9/1998 Janek ..... B65D 19/0091 108/143
6,220,473 B1 4/2001 Lehman et al.
6,223,551 B1 5/2001 Mitchell
6,266,972 B1 * 7/2001 Bostic ..... F25D 3/06 62/371
6,412,545 B1 7/2002 Buff et al.
6,502,417 B2 1/2003 Gano, III
7,028,504 B2 * 4/2006 Derifield ..... B65D 81/3827 62/372
7,147,125 B1 12/2006 Slovak et al.
7,225,632 B2 6/2007 Derifield
7,908,870 B2 3/2011 Williams et al.
8,117,792 B2 2/2012 Kim et al.
8,348,087 B2 1/2013 Sawaki
2002/0134962 A1 9/2002 Romero
2005/0189404 A1 * 9/2005 Xiaohai ..... B65D 81/3862 229/103.11
2007/0051734 A1 * 3/2007 Kuhn ..... F25D 3/06 220/592.27
2007/0152551 A1 7/2007 Kim et al.
2007/0175523 A1 8/2007 Dryzun
2007/0271947 A1 11/2007 Hase et al.
2008/0136302 A1 6/2008 Avila
2008/0271402 A1 11/2008 Gingras
2009/0065514 A1 3/2009 Vovan
2010/0072211 A1 3/2010 Dickinson et al.
2010/0180616 A1 * 7/2010 Linder ..... A47F 3/0413 62/248
2010/0301057 A1 * 12/2010 Tattam ..... B65D 88/14 220/592.25
2010/0314397 A1 12/2010 Williams et al.
2011/0049164 A1 * 3/2011 Banks ..... B65D 19/02 220/592.01
2011/0248038 A1 * 10/2011 Mayer ..... B65D 81/382 220/592.27
2011/0284556 A1 11/2011 Palmer et al.
2011/0290792 A1 * 12/2011 Krzak ..... B65D 81/3816 220/1.5
2013/0020309 A1 * 1/2013 Tattam ..... B65D 81/18 219/441
2014/0260933 A1 9/2014 Ardiff et al.
2015/0166244 A1 * 6/2015 Wood ..... B65D 81/18 220/592.25
2017/0240337 A1 * 8/2017 Austerberry ..... B65D 81/3818

FOREIGN PATENT DOCUMENTS

EP 1069048 A1 1/2001
EP 1099646 A1 5/2001
EP 1177984 A2 2/2002
EP 1384685 A1 1/2004
FR 2194671 A2 3/1974
FR 2948342 A1 1/2011
GB 1121180 7/1968
GB 361660 11/1981
GB 20186353 A 5/1982
GB 2193301 A 2/1988
GB 2293160 A 3/1996
GB 2459392 A 10/2009
GB 2500657 A 2/2013
JP 2000274589 A 10/2000
JP 6439676 * 11/2018 ..... B65D 81/3816
WO 93/24797 12/1993
WO 99/02412 1/1999
WO 99/22190 5/1999
WO 99/32374 7/1999
WO 00/49855 8/2000
WO 02/099345 12/2002
WO 03/086269 10/2003
WO 2004/083058 A1 9/2004
WO 2005/036076 A1 4/2005
WO 2006/031189 A1 3/2006
WO 2006/083633 A2 8/2006
WO 2008/137883 A1 11/2008
WO 2010/055295 A1 5/2010
WO 2010/132726 A1 11/2010
WO 2010/136769 A1 12/2010
WO 2014/076526 A1 5/2014

* cited by examiner

THERMALLY INSULATED CONTAINERS

The present invention relates to thermally insulated containers, in particular, but not exclusively, to palletised insulated containers, and to components for use therein.

It is frequently necessary to transport temperature sensitive goods by road, rail or air. Typically such goods are packed within an insulated container which contains thermal conditioning elements, typically in the form of coolant packs, which are arranged around the goods to maintain the goods at a desired temperature. The packs may be housed in sleeves which are attached to the inner wall of the container, for example as shown in GB-A-2459392. In another arrangement, the packs may be housed in channels formed internally of an insulating body as shown in GB-A-2500657.

The present invention seeks to provide an improved insulated container which is easy to manufacture and assemble.

From a first aspect, the invention provides a thermal conditioning wall panel for use in a thermally insulating container, comprising: a panel body having a channel formed therein along one face of the body for receiving one or more thermal conditioning elements, and at least one foot formed at the lower end of the panel body for engagement within a socket provided on the thermally insulating container; the panel further comprising thermal conditioning element retaining elements provided adjacent the longitudinal edges of the channel, said retaining elements projecting over a peripheral portion of the channel for retaining the thermal conditioning elements within the channel.

In this way, thermal conditioning elements such as coolant blocks or bricks may easily be mounted in a thermally conditioning wall panel. The retaining elements extend sufficiently far over the channel to prevent the thermal conditioning elements falling out of the channels, but do not extend fully across the channel. This reduces the weight of the panel.

The panel body is preferably thermally insulating and is preferably made from a thermally insulating material, for example an expanded foam material.

The lower end of the channel may be at least partially closed to prevent the thermal conditioning element(s) from falling out the bottom of the channel. This may mean that the panel may be carried upright with thermal conditioning elements mounted therein for assembly purposes. In certain embodiments, the lower end of the channel is fully closed, thereby providing good support to the thermal conditioning elements and also spreading their weight over the width of the body.

The thermal conditioning element retaining elements may be formed as an integral part of the panel body. However, in advantageous embodiments the thermal conditioning element retaining elements are separate elements attached to the panel body. Such an arrangement as the advantage that the retaining elements may be made from a different material from that of the panel body, for example a stronger material than the material of the panel body, thereby retaining the thermal conditioning elements more securely in the channel. It also means that the retaining element may be relatively thin, for example 1-2 mm in thickness, so that it does not project significantly from the panel body.

In a particularly advantageous embodiment, the retaining elements extend at least partially around the longitudinal edges of the panel body. In this way, not only do the retaining elements act to retain the thermal conditioning elements in the channels, but they also act to strengthen the edges of the panel body, and potentially provide some additional stiffness and strength to the panel. This is particularly advantageous when, as discussed above, the panel body is a thermally insulating material such as a foam material, for example an expanded foam material such as expanded polystyrene.

In preferred embodiments, the retaining elements are generally C shaped in section, extending around the edges of the panel body.

The retaining elements may be resilient and may be plastics elements, for example extruded plastics elements. This facilitates manufacture of the retaining elements.

The retaining elements may be attached to the panel body in any convenient manner, for example by adhesive or under their own inherent resilience. In one embodiment, however, they may be push fitted into the panel body, for example into receiving slots or apertures formed in the insulating body.

In certain embodiments of the invention, the foot may extend across substantially the entire lower end of the panel body. This will provide good engagement with the thermally insulating container.

The foot may project away from at least one face of the panel body, more particularly away from the face of the panel body having the channel. This may provide a larger foot profile which may assist in mounting the panel in the container. In certain embodiments, the foot may project from both faces of the panel body.

The above construction thought to be a novel and advantageous arrangement per se, so from a further aspect, the invention provides a thermal conditioning wall panel for use in a thermally insulating container, comprising: a panel body; the panel body having opposed faces and at least one channel for receiving one or more thermal conditioning elements, and at least one foot formed at the lower end of the panel body for engagement within a socket provided on the thermally insulating container; the foot projecting outwardly relative to at least one of the faces of the panel body.

The foot may be of any convenient shape for engagement with the container socket, for example rectangular, oval or trapezoidal.

The foot may extend over only a partial thickness of the panel body. This may form a step on the lower end of the insulating body. This may aid in stabilising the panel when assembled, but also means that in constructions where the foot projects from the wall panel, the foot may be received within the step of a similar wall panel when the panels are placed adjacent one another, allowing a compact stacking arrangement.

The step is preferably generally perpendicular to the face of the panel.

In some embodiments, a reinforcing cap may be mounted to the lower end of at least one longitudinal edge of the panel body so as to extend inwardly over a portion of the foot and upwardly over at least a lower portion of the longitudinal edge. This provides additional strength to the foot and the lower part of the panel body, which may be advantageous when, as discussed above, the body is of a foam material.

In some embodiments the face of the channel receiving the thermal conditioning elements is provided with one or more longitudinal grooves. This may be advantageous in that it will allow for circulation of air around the thermal conditioning element within the channel. This may be particularly advantageous if the thermal conditioning elements are being conditioned in situ within the wall panel.

In addition, the face of the panel body opposite the channel may be provided with one or more longitudinal grooves. This may be advantageous in cases where a stack of panels containing thermal conditioning elements is being conditioned as it will improve the circulation of air around the thermal conditioning elements.

The thermal conditioning wall panels may also be stacked side by side in a rack having a plurality of sockets for receiving adjacent panels.

From a further aspect the invention provides a method of conditioning thermal conditioning elements for use in a thermally insulating container comprising mounting the elements in respective channels provided in a plurality of wall panels, and arranging the wall panels vertically adjacent one another, side by side in a thermal conditioning environment.

The invention also extends to a thermally insulated container comprising a base panel having a plurality of sockets arranged around a periphery thereof, and one or more panels as described above received in those sockets.

The container may further comprise a plurality of outer side wall panels of a thermally insulating material mounted to the base of the outwardly of the inner side wall panels.

In one particular embodiment, the outer side wall panels may be arranged to lie over projecting portions of the feet of the inner side wall panels to assist in retaining the feet in the base sockets. This provides a particularly stable construction, the outer wall panels in effect locking the inner wall panels in position. Also, as the projecting portions of the feet project outwardly, they do not encroach with the payload space defined within the inner wall panels.

From a further broad aspect, therefore, the invention provides a thermally insulated container comprising a base having a one or more sockets arranged around a periphery thereof, one or more inner side wall panels received in those sockets and one or more outer side wall panels of a thermally insulating material mounted to the base of the outwardly of the inner side wall panels, the inner side wall panels having one or more outwardly projecting portions, the outer side wall panel lying over the projecting portions to assist in retaining the inner side wall panels in the base.

To facilitate assembly, the base panel may comprise a peripheral formation, such as a rib or socket for locating the lower ends of the outer side wall panels.

Depending on the size of the respective inner and outer side wall panels, an outer wall panel may extend over a plurality of inner side wall panels. This facilitates assembly.

The container may also comprise one or more inner top panels, also for receiving thermal conditioning elements, mounted to the upper ends of the side wall panels.

In some embodiments, the top panel may comprise a tray element having one or more open topped compartments for receiving thermal conditioning elements. The tray element may comprise one or more divider elements extending between longitudinal walls of the tray element to define the compartments.

The tray is advantageously formed of a thermally insulating material such as an expanded foam material and the divider element(s) may be formed integrally with the tray. The divider elements may thereby act to strengthen the tray. To further strengthen the tray, the tray may be provided with one or more reinforcing elements extending along one or more longitudinal edges thereof. This may be of particular importance where the tray is formed from an expanded foam material, as discussed above.

The reinforcing elements may extend at least partially around the longitudinal edges of the tray.

The reinforcing elements may be plastics elements, for example extruded plastics elements.

The reinforcing element may be attached to the tray in any convenient manner, for example by adhesion, clipping or by push fitted into the body of the tray.

In some embodiments, the tray element may comprise one or more downwardly projecting lip elements for engagement over the upper edges of the inner side wall panels of the container. This may assist in locating the tray and also may, to some extent, lock the inner side wall panels together.

In some embodiments, corner regions of the tray element may be relieved as to form handles for the tray, to facilitate handling.

The container may further comprise a lid mounted to the upper ends of the outer side wall panels.

The lid may comprise a plurality of sections, at least one of which is movable to a position to create an opening for providing access to the interior of the container.

Advantageously, the section may be configured and arranged relative to the underlying inner top panel such that the underlying inner top panel can be removed through the opening.

The lid sections may be connected by a hinge, for example a living hinge, such that one section can be pivoted about the hinge to create the opening. This may allow the movable section to be pivoted over on top of the other section which will then support the movable section.

The hinge may be formed of a plastics element having two wings connected by a hinge region, each wing connected to a respective lid section.

The base may also be formed in multiple parts, suitably joined together, for example with a hinge as discussed above.

From a further broad aspect, the invention extends to panel for use in a thermally insulating container, the panel comprising a body of a thermally insulating material in the form of a tray element having one or more upwardly open compartments for receiving thermal conditioning elements therein.

The tray panel may include any of the other features discussed above.

The invention also extends to a lid for a thermally insulating container comprising a plurality of sections of a thermally insulating material, at least one section being hingedly connected to another section through a hinge such that one section can be pivoted about the hinge to lie on top of the other section.

An embodiment of the invention will now be described, by way of example only, with reference to the accompanying drawings in which.

Figure 14:
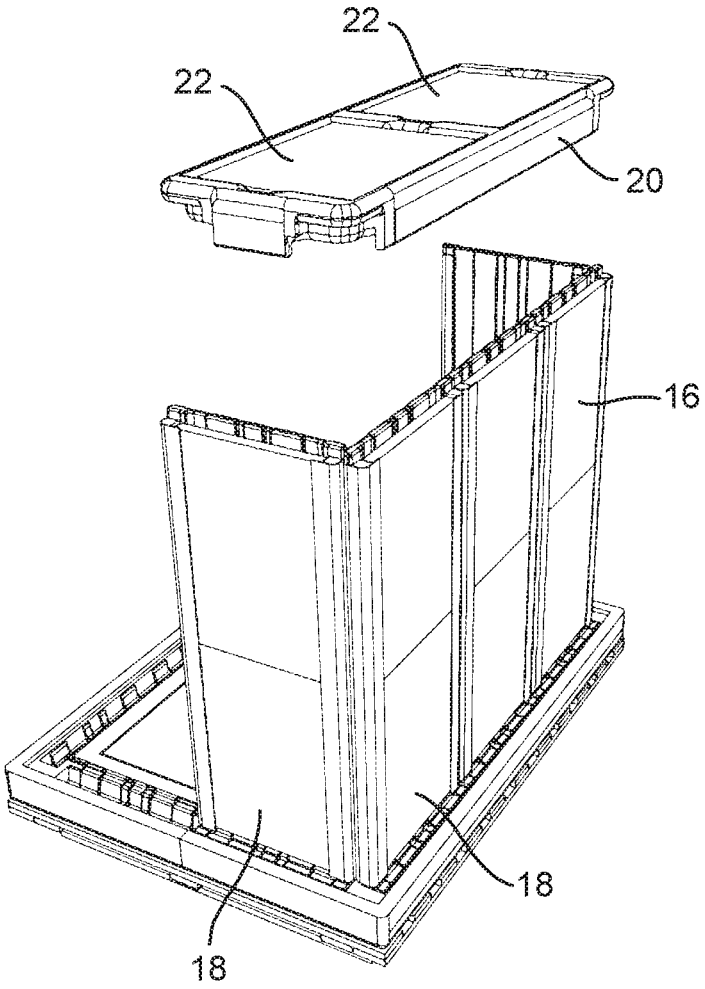
Figure 15A:
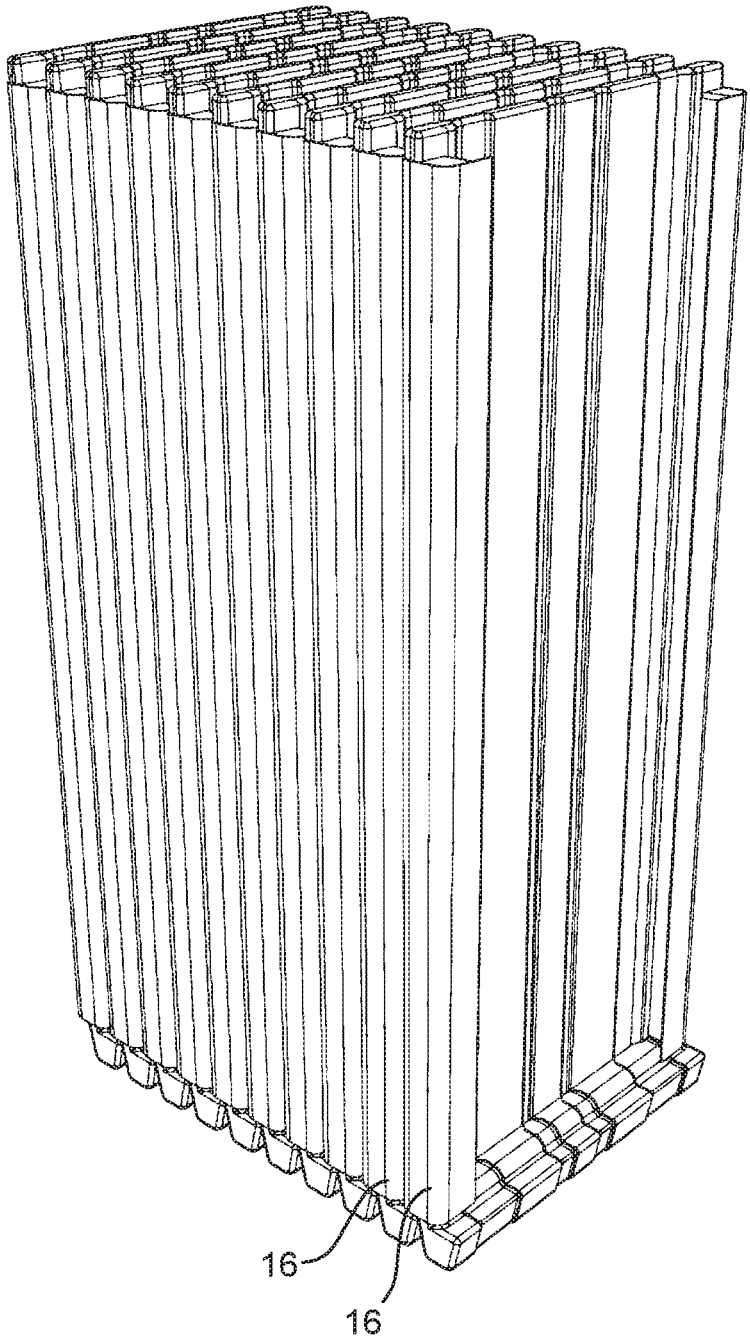
Figure 15B:
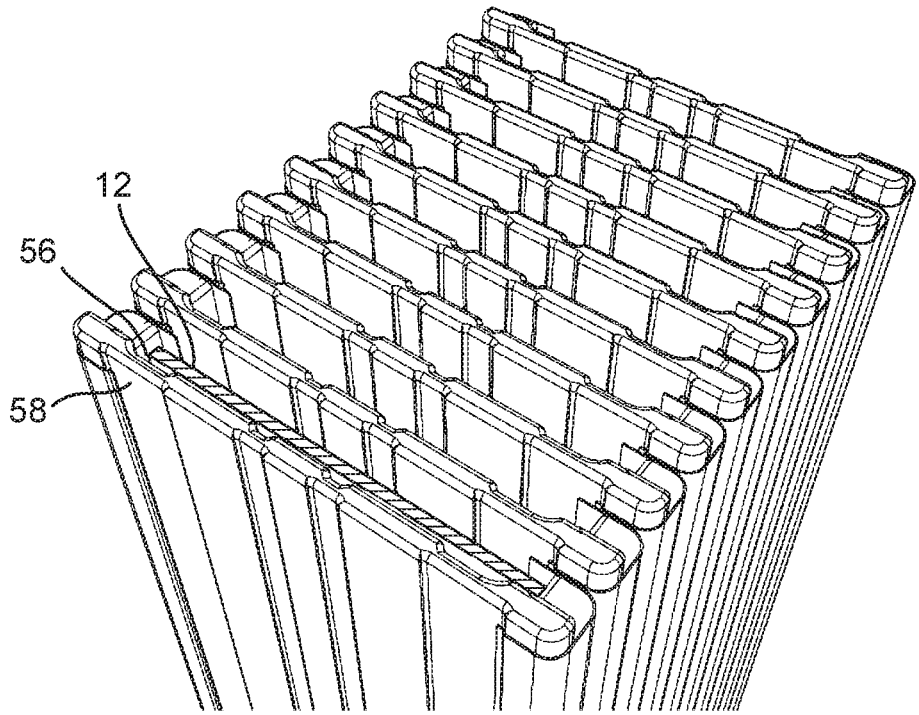
Figure 16:
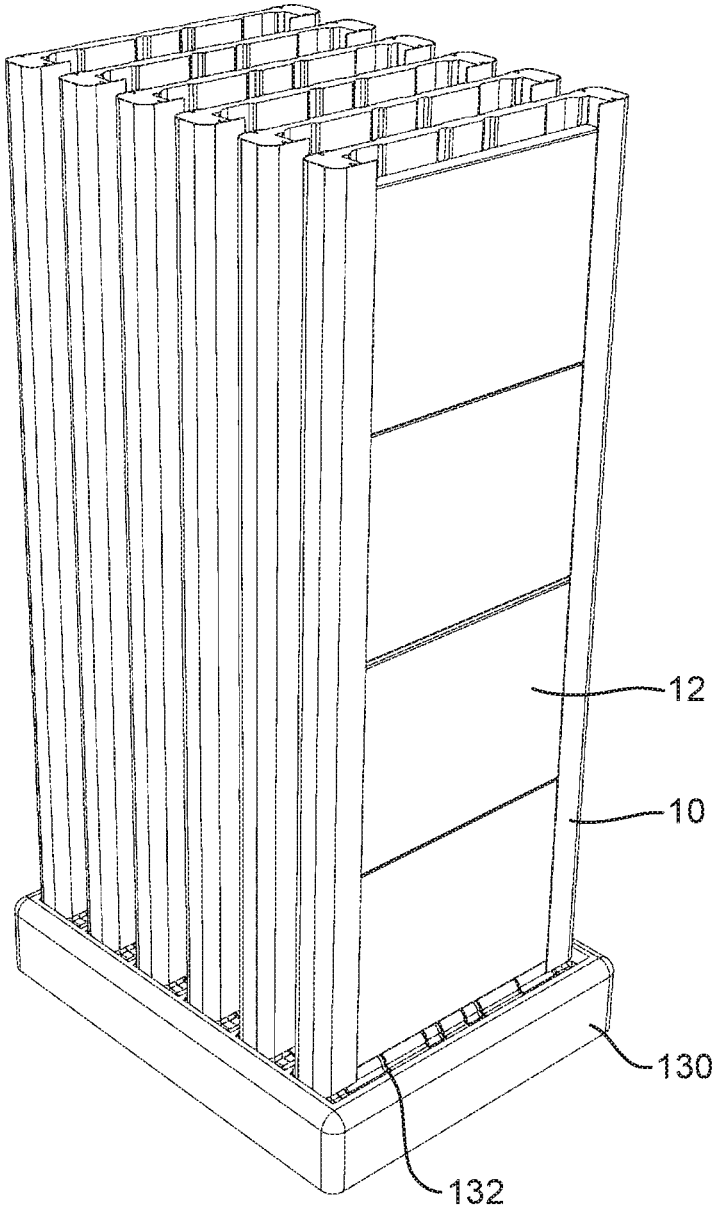
Figure 17:
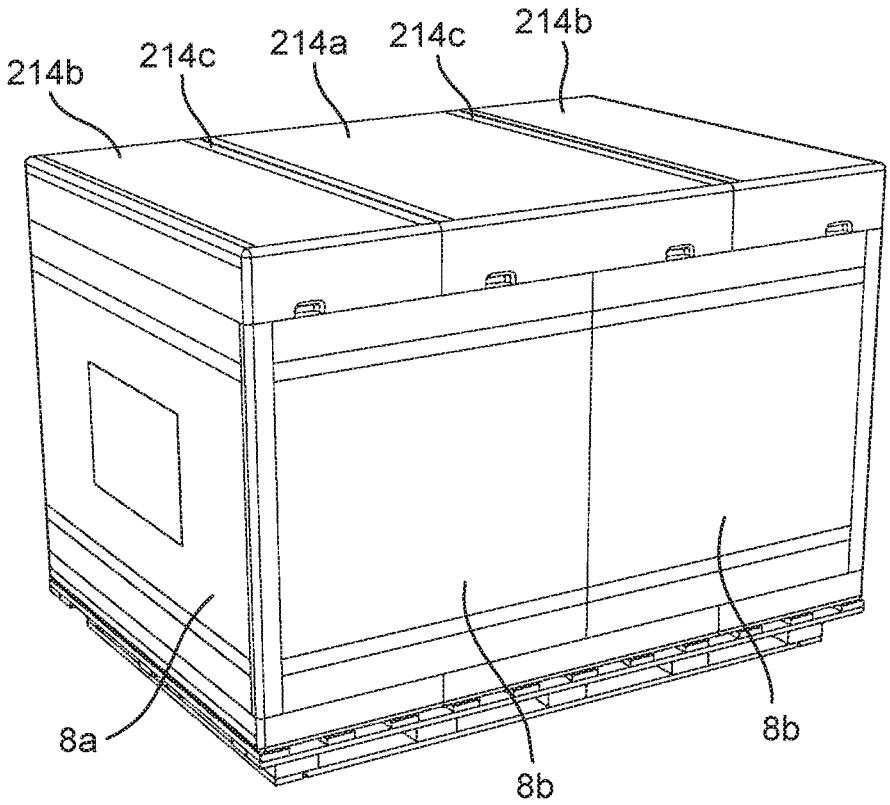

FIGS. 13*a* to 13*d* illustrate one method of erecting the container;

FIG. 14 illustrates an alternative method of erecting the container;

FIGS. 15*a* and 15*b* show front and rear perspective views of a stack of thermally conditioning wall panels;

FIG. 16 shows a plurality of thermally conditioning wall panels in a rack; and FIG. 17 shows a further container in accordance with the invention.

With reference firstly to FIGS. 1 to 4, a thermally insulated container 2 in accordance with an embodiment of the invention is illustrated.

The container 2 is collapsible and comprises an assembly of panels. The container firstly comprises a base panel 4 which may be mounted on or attached to a pallet 6. The base panel 4 receives a plurality of outer side wall panels 8 and a plurality of inner, thermally conditioning side wall panels 10. As will be described further below, the inner side wall panels 10 house blocks of thermal conditioning material 12.

Mounted to the tops of the inner side wall panels 10 are a plurality of inner top panels 14 in the form of tray elements. The top panels 14 also receive blocks 16 of thermal conditioning material. A payload space 18 is defined between the base panel 4, the inner side wall panels 10 and the top panels 14.

A lid 20 is mounted to the top of the outer side wall panels 8 to close the container 2.

Figure 5:
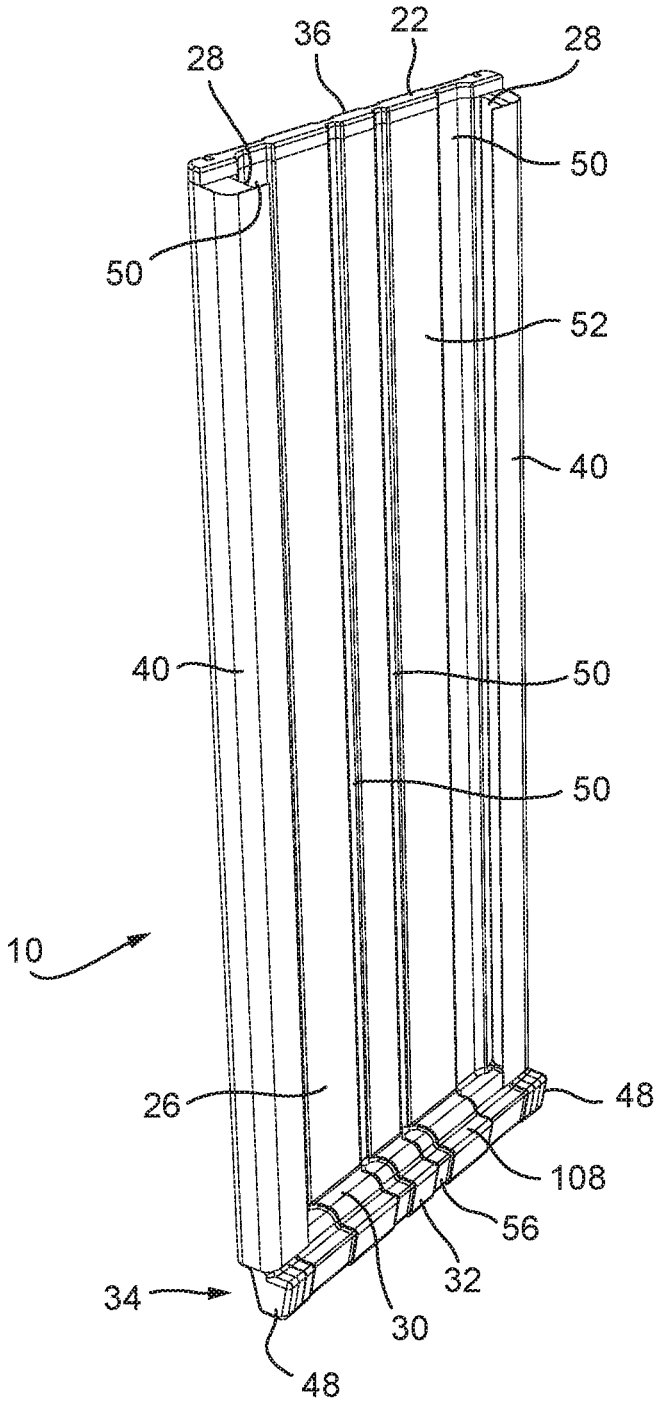
FIG. 5 shows a front perspective view of an inner side wall panel.
Figure 6:
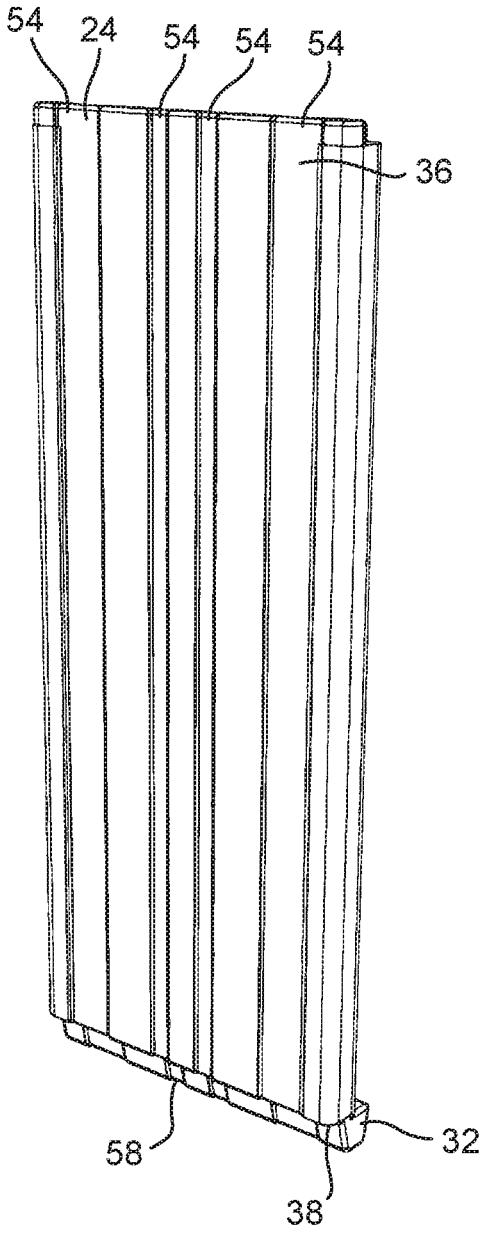
FIG. 6 shows a rear perspective view of an inner side wall panel.
Figure 7:
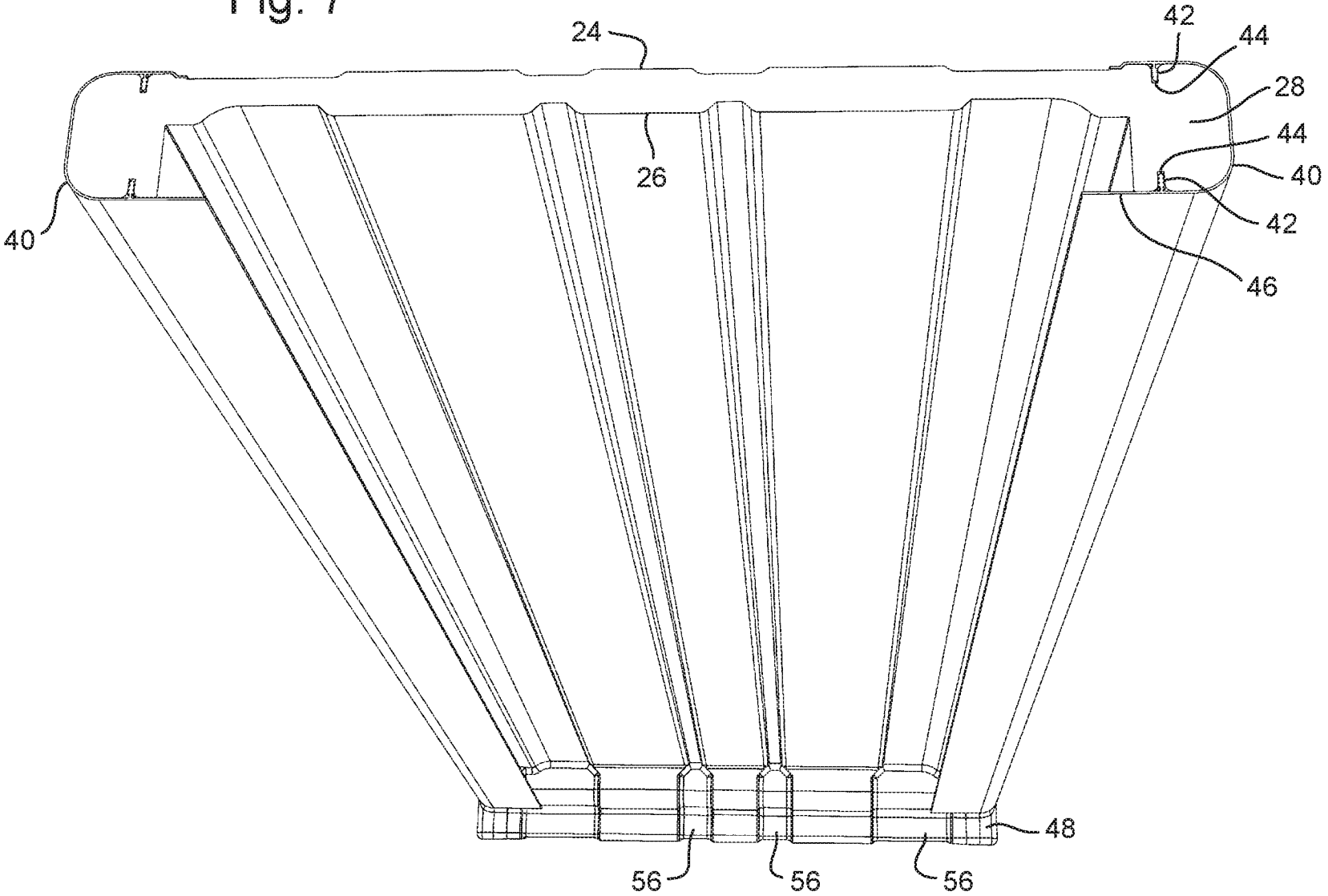
FIG. 7 shows a top perspective view of an inner side wall panel.

With reference to FIGS. 5 to 7, an inner side wall panel 10 will be described in further detail.

The inner side wall panel 10 comprises a body 22 made from a thermally insulating material. The material may, for example, be an expanded foam, for example, expanded polystyrene foam, for example Neopor®. One face 24 of the body 22 is formed with a channel 26. The channel 26 is bordered on respective sides by longitudinal ribs 28 formed along the longitudinal edges 29 of the body 24. The lower end of the channel 26 is closed across its entire width by a base wall 30.

A foot 32 extends from the lower end 34 of the body 22. As can be seen, for example, from FIG. 5, the foot 32 is generally trapezoidal in shape, although other shapes are possible within the scope of the invention. It will also be seen that the foot 32 does not extend to the face 36 of the body 24 opposite the face 24 having the channel 26. Rather it terminates generally below the end of the channel 26 thereby forming a shoulder or step 38 on the lower end 34 of the panel 16.

The inner side wall panels 10 are further provided with a pair of thermal conditioning retaining elements 40 which extend along and are attached to the longitudinal edges 29 of the body 22. As can be seen from FIG. 7, each retaining element 40 is generally C-shaped in cross-section and is provided with a pair of fins 42 extending from opposed surfaces which are received in corresponding slots 44 formed in the body 22. The fins 42 may engage the slots 44 with an interference fit so as to locate the retaining elements 40 on the body 24, although alternative or additional attachment means may be provided, for example adhesive or other forms of fastener. Thus, for example, the fins 42 may be omitted in other embodiments.

In this embodiment, the retaining elements 44 are formed of a plastics material for example polypropylene and are extruded for ease of manufacture. In the arrangement shown, the retaining elements 40 may simply be attached to the edges 29 of the body 22 by being slid down the body 22 from above.

It would be noticed that one limb 46 of the retaining elements 40 extends over an edge region of the channel 26 such that the limbs 46 will retain the thermal conditioning elements 12 within the channel 26.

In other embodiments, it is not necessary for the retaining elements 40 to extend around the edge 29 of the body 22. For example, the retaining elements 40 may simply be strips mounted to a face of the ribs 28, or generally L-shaped extending partially around the edge 29.

The body 22 of the inner side wall panel 16 may, as discussed above, be made from an insulating material, for example, a foam material. The retaining elements 40 will also act to provide some degree of rigidity to the body 22.

Figure 8:
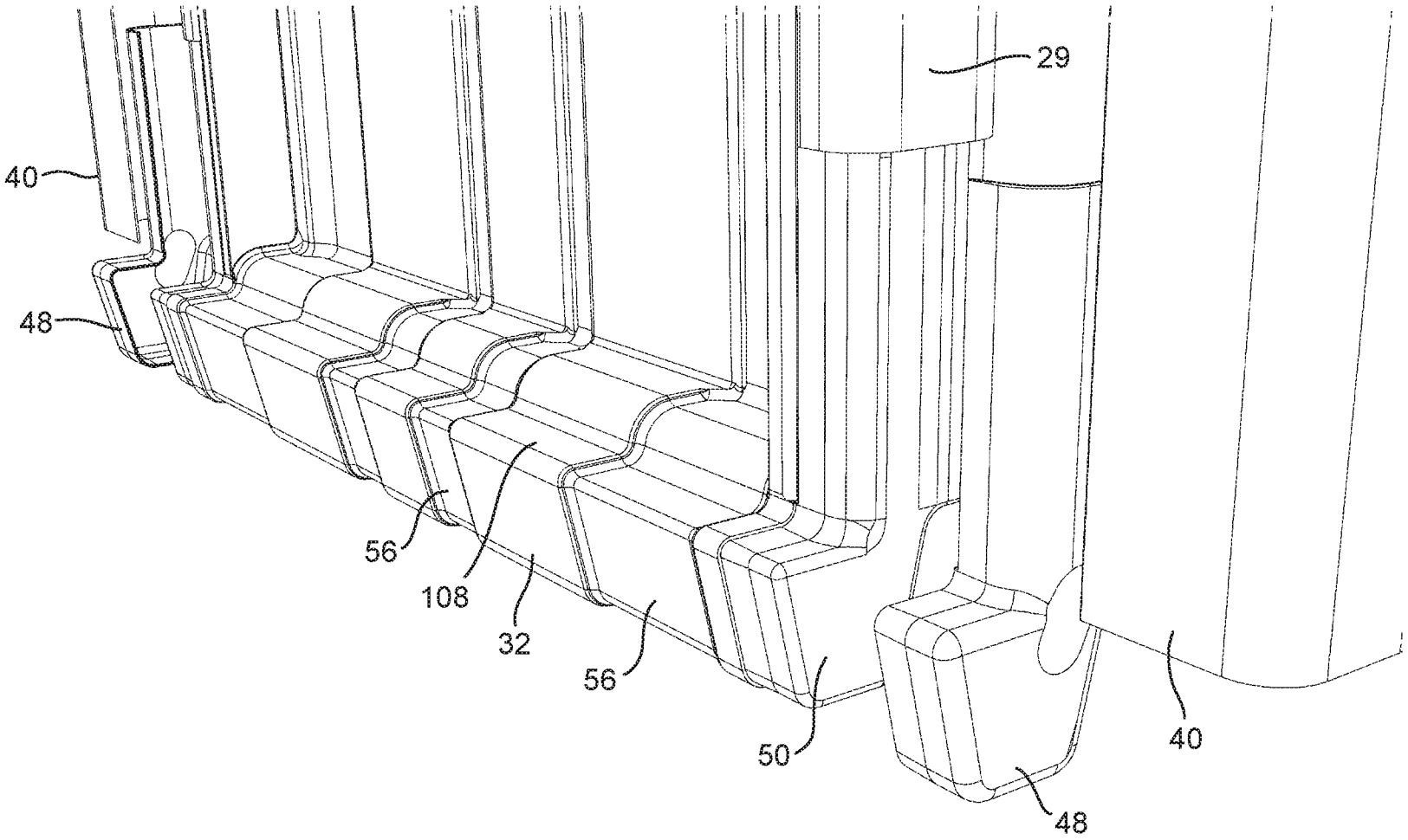
FIG. 8 shows an exploded view of a lower end of an inner side wall panel.

In order to provide additional strength, particularly at the lower end 34 of the body 22, reinforcing caps 48 may be mounted to the respective lower longitudinal sides of the body 22. These caps 48 will have a profile which matches that of the foot 32 and the lower part 50 of the longitudinal edge 29 of the body 22 and extend a desired length up the longitudinal edge 29 from the foot 32, as illustrated in phantom in FIG. 8.

The cap 48 may be made from a suitable reinforcing material, for example, a plastics material, in particular a relatively rigid plastics material such as ABS, or even a metallic material. In this embodiment, the cap 48 fits beneath the retaining elements 40 and does not interfere with the thermal conditioning elements 12 received in the channel 26. Moreover, as can also be seen from FIG. 8, the lower part 50 of the edge 29 is recessed to receive the cap 48.

It will also be noted that the channel 26 is provided with a plurality of grooves 50 in its face 52. Also, the opposed surface 36 of the body 22 is also provided with shallow grooves 54. In this embodiment the grooves 50, 54 are generally aligned although this is not necessary. The purpose of these grooves 50,54, will be described further below.

It will also be seen that the foot 32 is also provided with grooves 56 and 58. In fact, in this embodiment a continuous groove is formed around the foot to form the respective grooves 56, 58, although this is not essential.

Figure 13A:
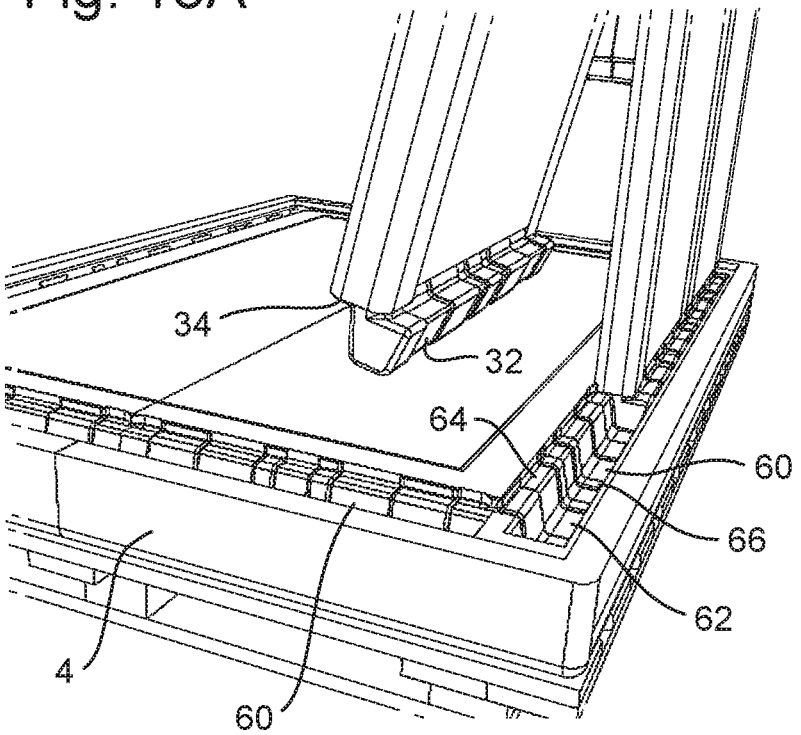

With reference to FIGS. 5 and 13*a*, it will be seen that the base panel 4 of the container comprises a plurality of peripheral sockets 60 which receive the respective feet 32 of the inner side wall panels 10. The sockets 60 have a complementary shape to the foot profile having a generally trapezoidal main cavity 62 for receiving the foot, and a shelf 64 for receiving the platform 38 of the body 22. It will be seen, for example from FIG. 3 that the platform 38 lends stability to the inner side wall panel 10 as it resists the inner side wall panel 10 from tipping over into the container 2.

The sockets 60 also have ribs 66 for engaging in the grooves 56,58 of the foot 32, thereby assisting in locating the inner side walls panels 10 in the base panel 4.

Figure 2:
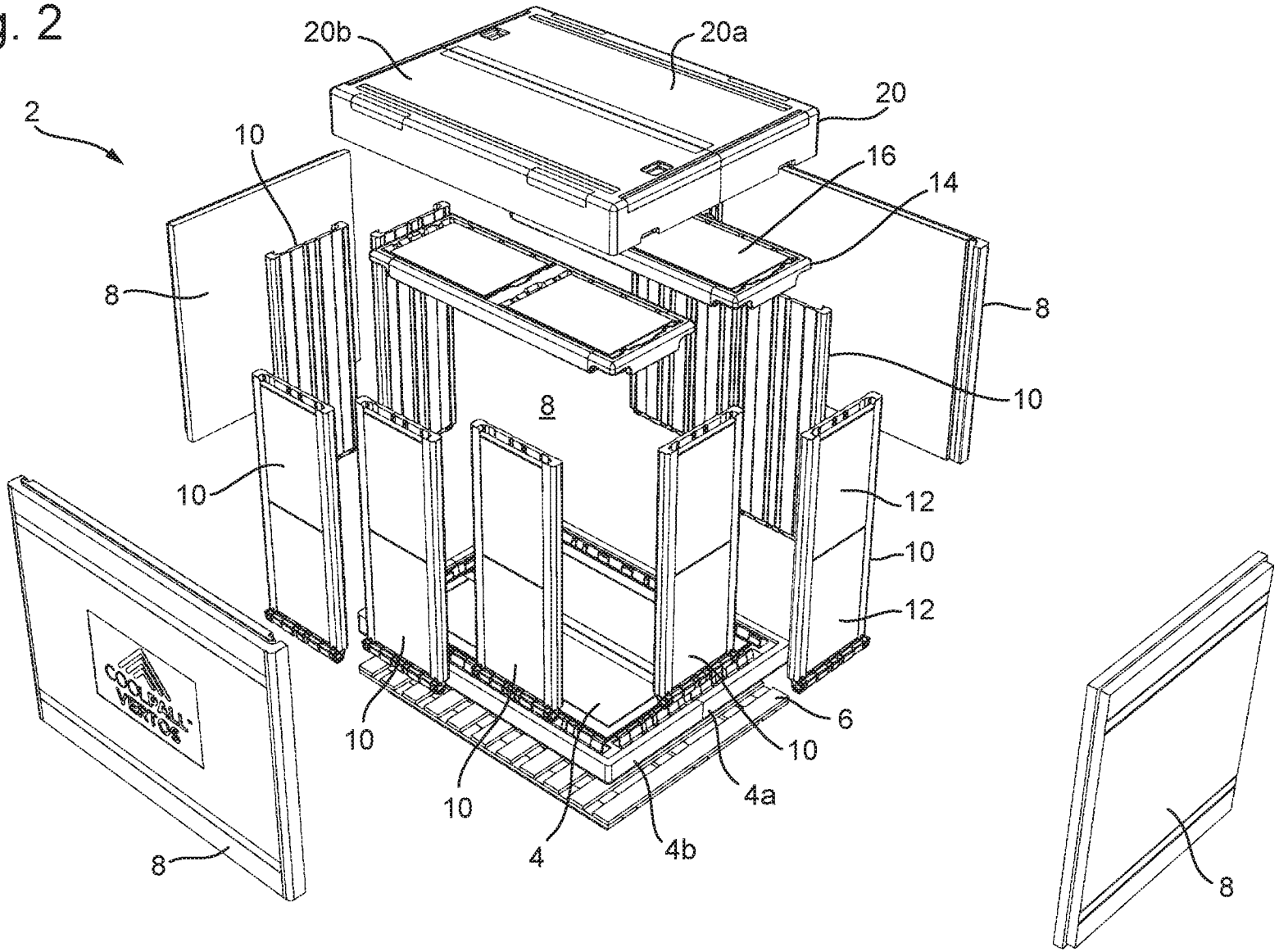
FIG. 2 shows an exploded view of the container of FIG. 1.
Figure 3:
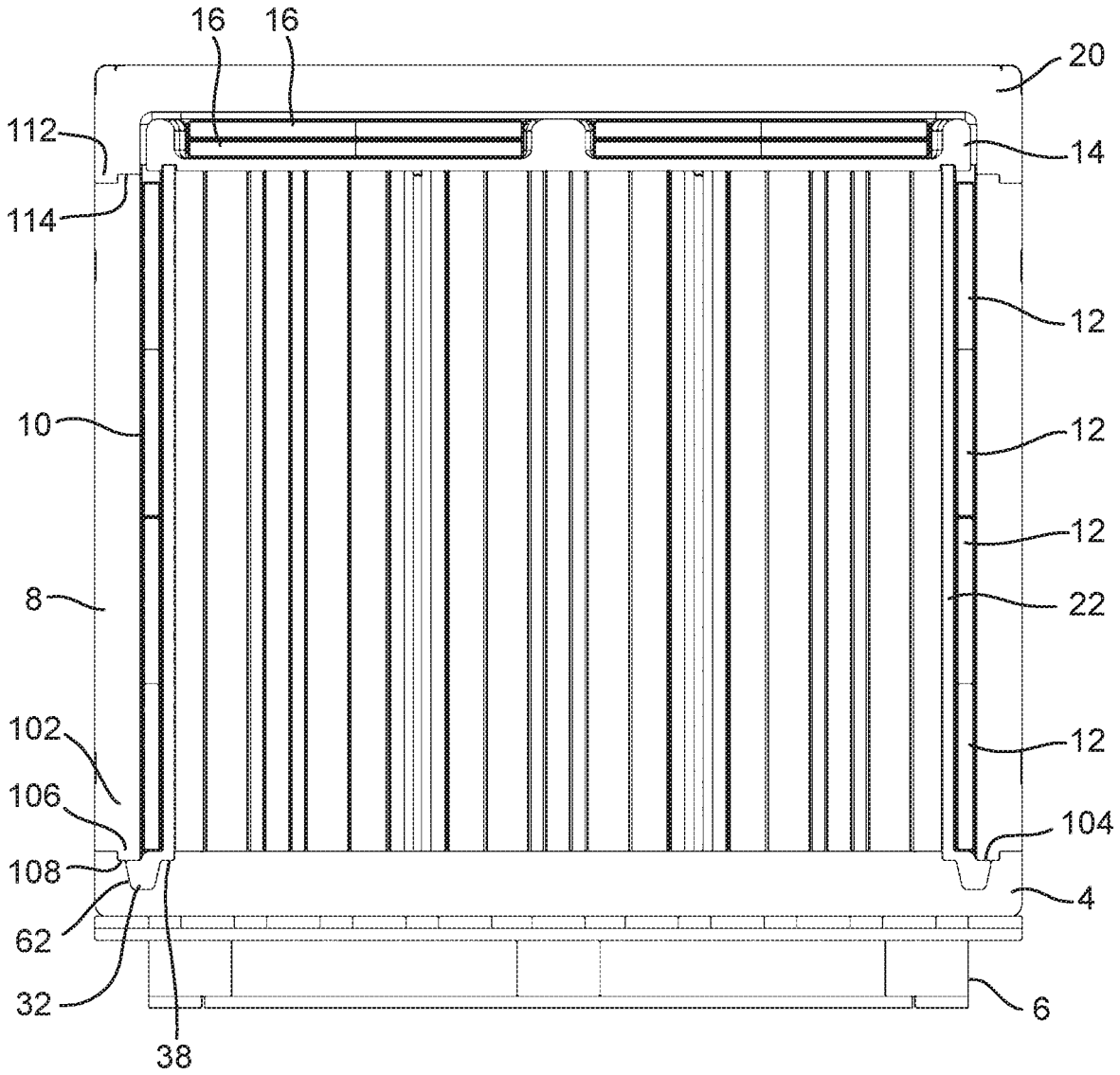
FIG. 3 shows a cross sectional view along line A-A of FIG. 1.

As can be seen from FIG. 2, the base panel 4 is formed in this embodiment in two parts 4*a*, 4*b* which are joined together at a hinge 4*c*. The hinge 4*c* may be a living hinge with respective wings 70 attached to the respective base parts 4*a*, 4*b*. However, this is not an essential feature and the base panel 4 can be made in a single part or in more than one part depending on the size of container 2.

In the illustrated embodiment, the base panel 4 is also made from a thermally insulating material, for example a foam material for example expanded polystyrene or other foam material. In this embodiment the base does not house any thermal conditioning elements, although if desired, such elements may be mounted in recesses formed in the base.

Figure 9:
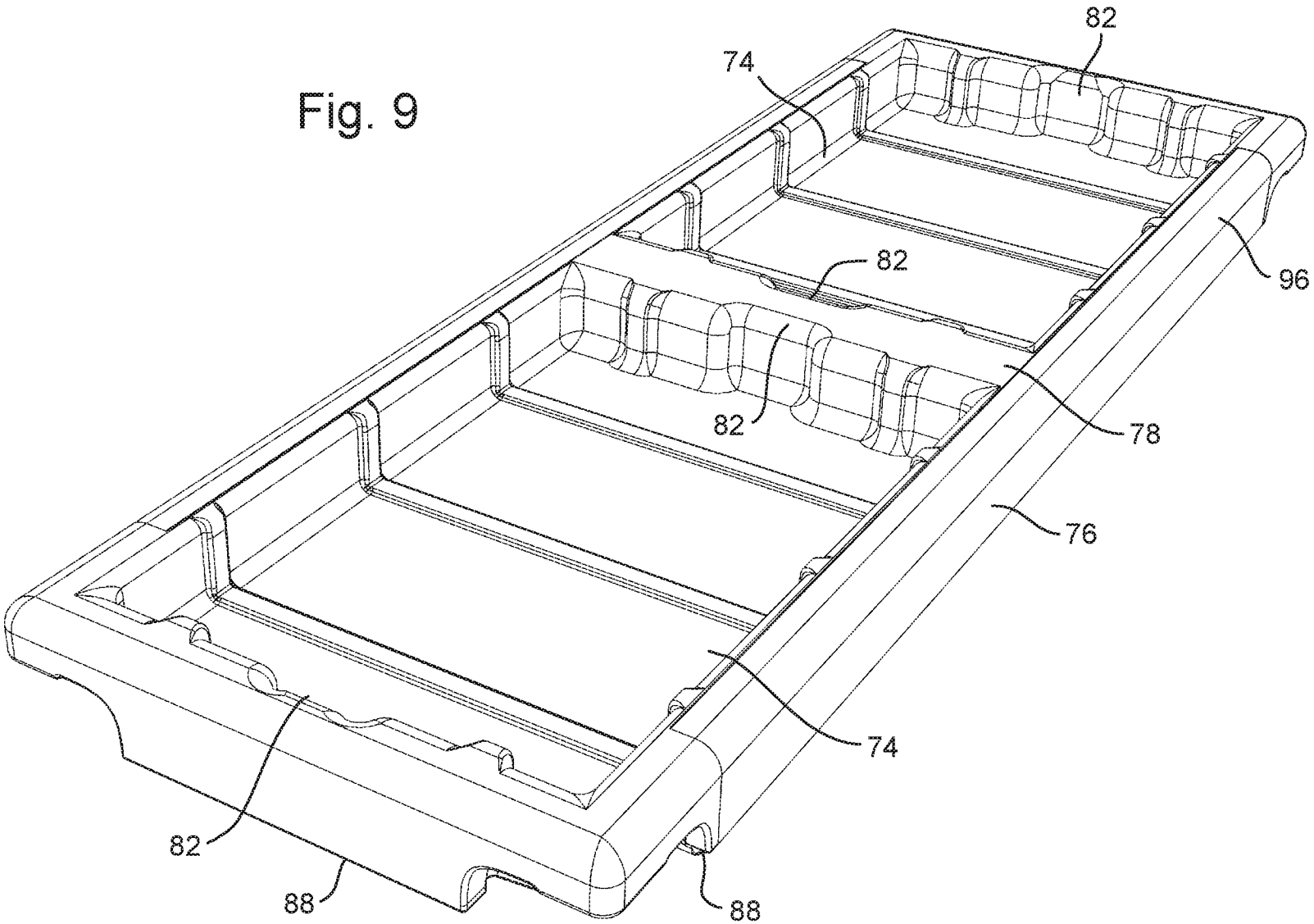
FIG. 9 shows a top perspective view of an inner top panel.
Figure 10:
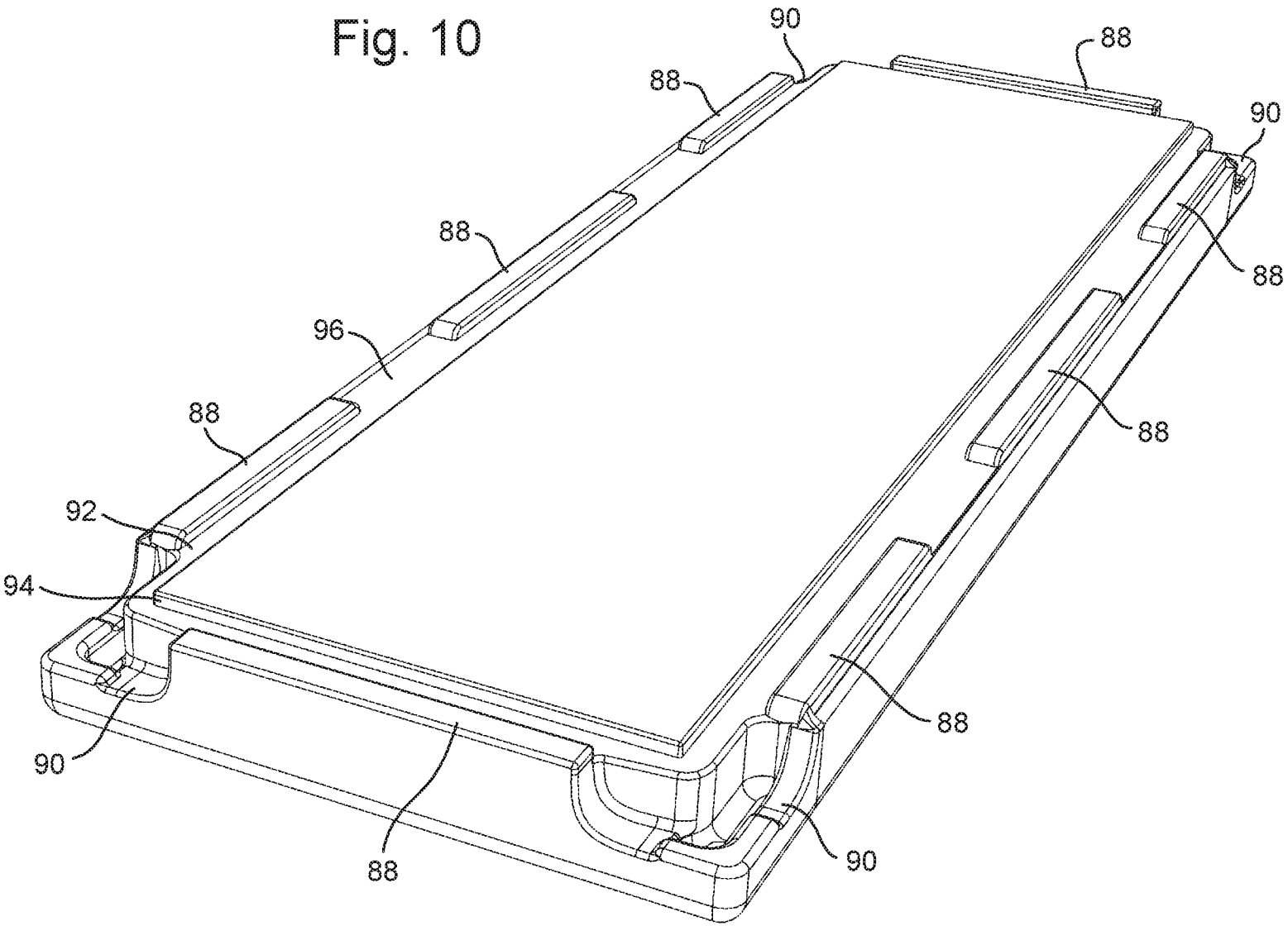
FIG. 10 shows a bottom perspective view of an inner top panel.

Turning now to FIGS. 9 and 10, an inner top panel 14 is shown in greater detail. The top panel 14 is in the form of a tray 72 having one or more compartments 74, in this embodiment two compartments 74, formed in its upper surface to receive thermal conditioning elements 16. In this particular embodiment, the compartments 74 are of such a depth that they may receive two thermal conditioning elements 16 in each compartment 74. This will compensate to some degree for the lack of thermal conditioning elements in the base panel 4.

In this embodiment, the top panel 14 is, as is the inner side wall panel 16, made from thermally insulating material, for example a moulded foam material, for example moulded expanded polystyrene, Neopor® etc.

The body 76 of the tray 72 is formed with a divider 78 which forms the respective compartments 74. The ribs 78 and the end walls 80 of the body 76 are formed with recesses 82 which will allow a user to insert his or her fingers under the thermal conditioning elements 16 during assembly or disassembly.

The body 76 of the tray 72 is provided, on its lower surface 86 with a series of peripheral lip elements 88. However, the lip elements 88 do not extend into the corner regions 90 of the tray 72. Moreover, the corner regions 90 are formed with recesses which define handles to facilitate handling of the tray 72. A channel 92 is formed around the periphery of the lower surface 86 between the lip elements 88 and a step 94 therein.

As the tray 72 may be made from an expanded foam material, additional rigidity may be added to the tray 72 by providing reinforcing elements 96 along the respective longitudinal edges thereof. The reinforcement elements 96 may, for example, be made from a plastics or metallic material and be suitably secured to the tray, for example by adhesive or by formations engaging with formations provided on the tray 72, for example in a similar manner to the retaining elements 40 of the inner side wall panels 10. Thus, for example, each reinforcement element 96 may be provided with one or more fins which engage in slots in the body 76 of the tray 72.

Figure 4:
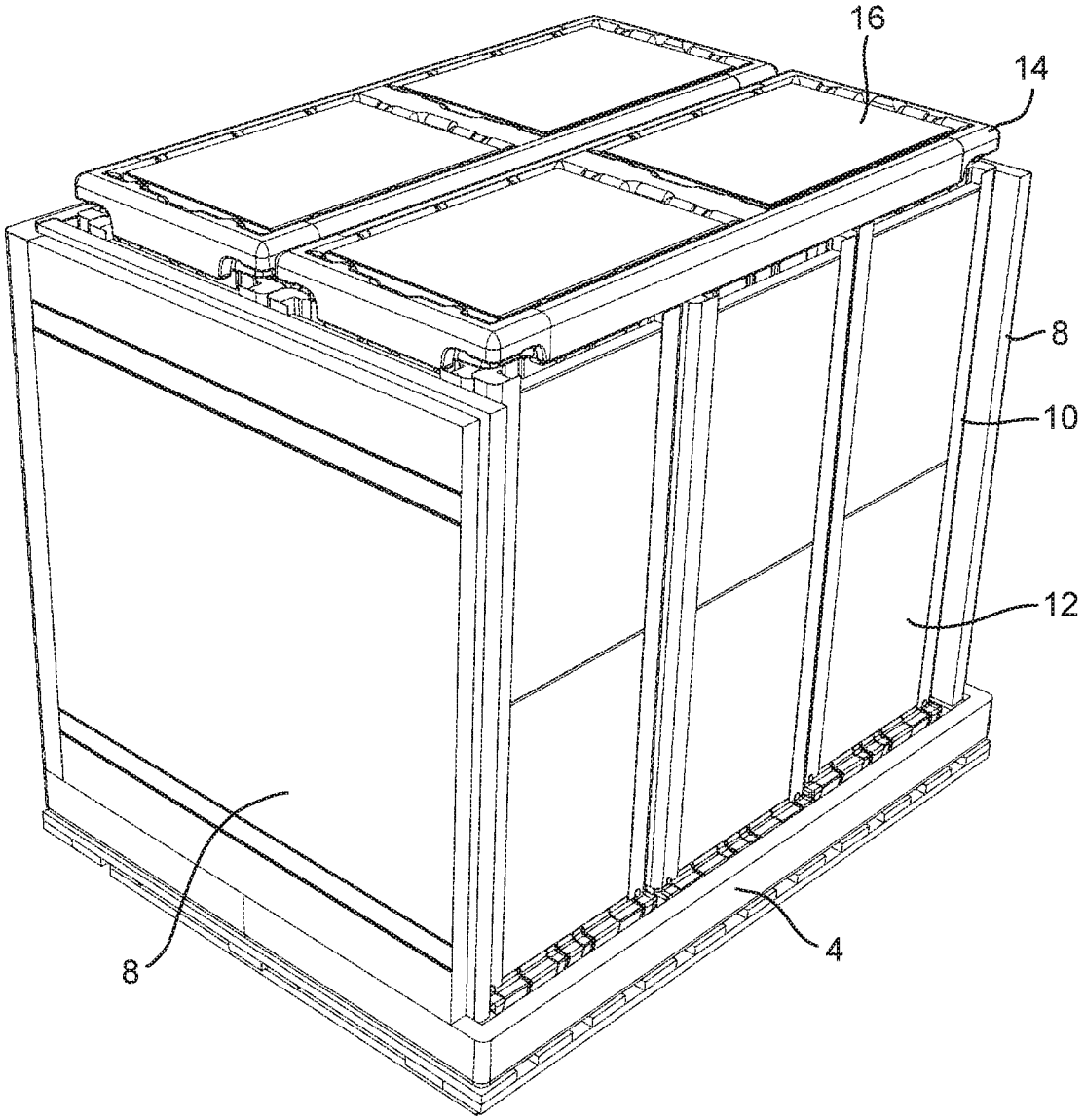
FIG. 4 shows the container with its outer side wall panels and lid removed.

As will be seen, for example from FIGS. 4 and 5, the top panel 14 locates over the upper edges of the inner side wall panels 16. In particular, lip elements 88 at opposite ends of the tray 72 engage over upper edges of opposed inner side wall panels 16, while lip elements 88 along one side of the tray 72 engage over upper edges of a plurality of adjacent inner side wall panels 10. In fact, the lip elements 88 are received in the upper parts of the respective inner side wall panel channels 26 (the thermal conditioning elements 12 not extending fully to the top of the channels 26). The tray 72 rests on the upper ends of the inner side wall panels 10, the upper ends engaging with the surface 96 formed at the base of the peripheral channel 92. Thus the inner side wall panels 10 are located by the channel 92.

It will be understood that when the top panels 14 are in place, a payload space 18 is defined between the inner face 36 of the inner side wall panels 10 and the bottom surface of the trays 72. It will be seen that the body 22 of each inner side wall panel 10 faces the interior payload space 18 of the container 2, thereby acting as a thermal spacer between the thermal conditioning elements 12 and the payload. This is potentially desirable in order to avoid direct thermal contact between the thermal conditioning elements 12 and the payload. The body 76 of the tray 72 acts in a similar manner. The thickness of the tray wall and the body 22 of the internal side wall panels 10 may be tailored to give the desired thermal properties.

Turning now to the outer side wall panels 8, these are also formed of a thermally insulating material, for example a foam material, for example, an expanded foam material, for example expanded polystyrene or Neopor®. In this embodiment, two types of side wall panel 8 are used. As can be seen in FIG. 13*d*, a first side wall panel 8*a* has a generally U-shaped cross-section having side limbs 100 which extend around a corner of the container 2. The other panel 8*b*, is essentially planar, engaging between the wings 100 of opposed panels 8*a*. The wings 100 have grooves to receive the ends of the panels 8*a*. As can be seen for example from FIG. 3, the lower end 102 of each outer side wall panel 8*a* is formed with a step to provide a projecting portion 106 which is received in a peripheral channel 108 of the base panel 8. Thus, when the outer side wall members 8*a*, 8*b* engage with the base panel 4, the projecting portion 106 overlies the upper surface 104 of the inner side wall panel foot 32. This provides additional stability to the inner side wall panels 10, particularly during assembly.

Figure 1:
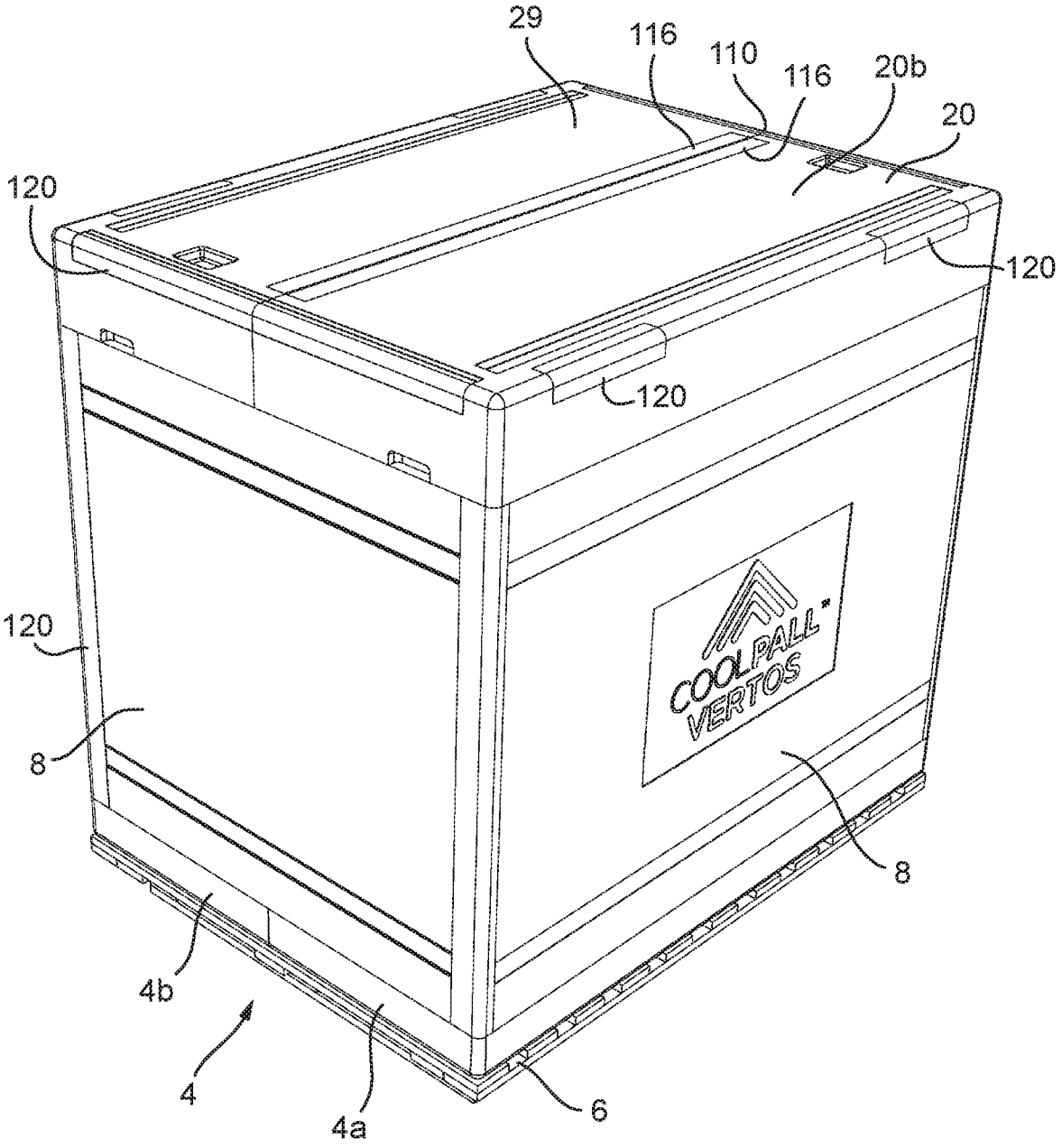
FIG. 1 shows a perspective view of a thermally insulated container in accordance with the invention.

The lid member 20 comprises two lid portions 20*a*, 20*b* hingedly connected by a hinge 110, as shown in FIG. 1.

Each lid portion 20*a*, 20*b* is formed of a thermally insulating material, for example a foam material, for example an expanded foam material such as expanded polystyrene. It comprises a depending lip 112 which engages with an upwardly extending lip 114 provided on the respective outer side wall panels 8*a*,8*b* in order to locate the lid 20 in position on the outer side wall panels 8*a*, 8*b*.

Figure 11:
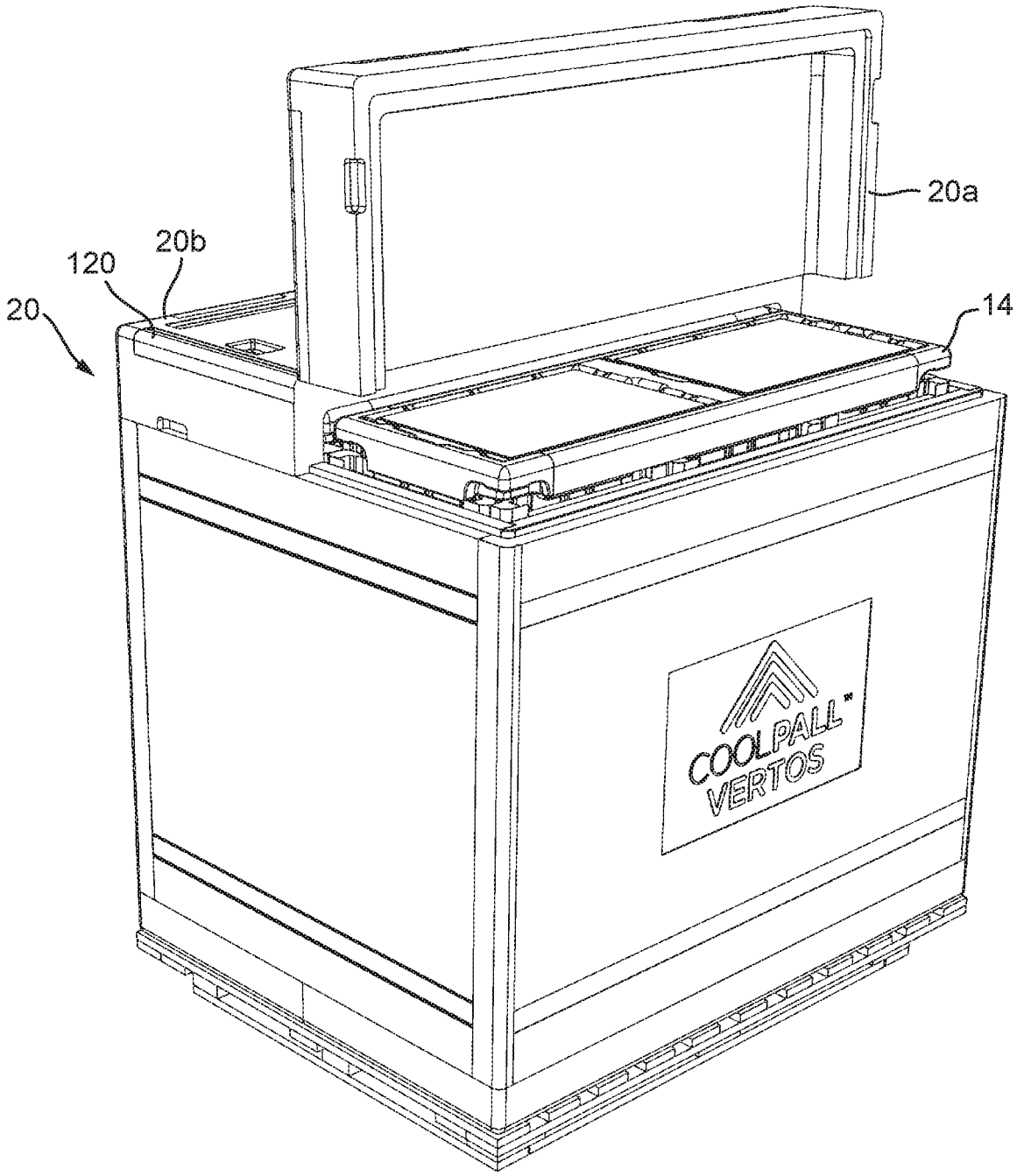
FIG. 11 shows a perspective view of the lid in an opening configuration.
Figure 12:
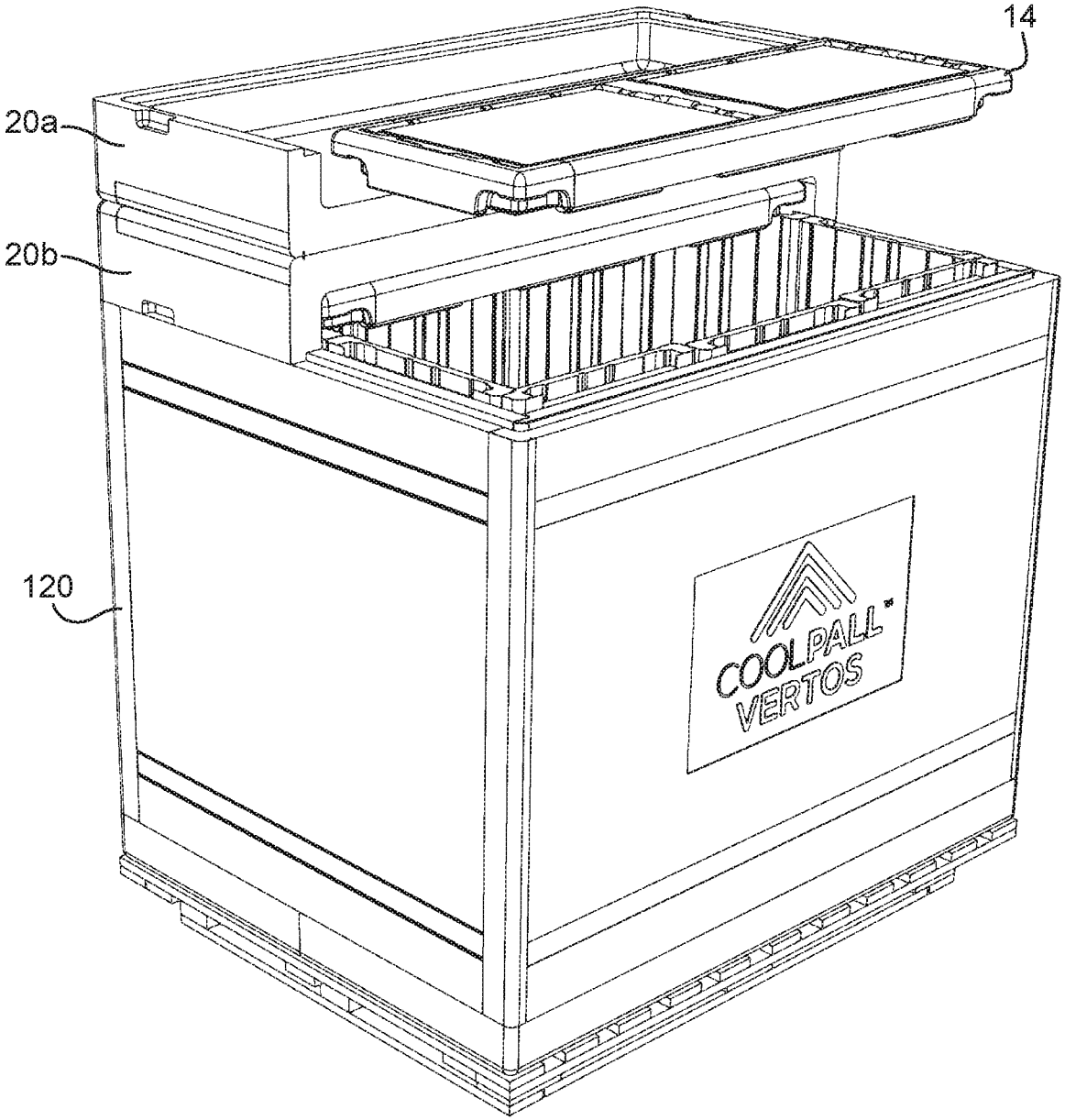
FIG. 12 shows a perspective view of the lid in a fully open configuration.

The hinge 110 may be of any suitable construction and may, for example, be a living hinge, for example formed from a plastics material. The hinge 110 may comprise respective wings 116 which are suitably attached, for example by fasteners or adhesive, to the respective lid portions 20*a*,20*b*. As can be seen from FIG. 11, this allows one of the lid portions 20*a*, 20*b* to be folded over and rested on the other of the lid portions 20*a*, and 20*b* as shown in FIG. 12.

The construction of the container 2 shown in FIG. 1 will now be described with reference to FIGS. 13 and 14. It will be understood that the container 2 is fully collapsible and is erected from its collapsed components. The system allows thermal conditioning elements 12 to be arranged in the inner side wall panels 10 either during assembly of the container 2 or prior to assembly.

With reference to FIG. 13*a*, as a first stage in assembly of the container 2 without the thermal conditioning elements 12, respective inner side wall panels 16 are positioned in the base panel 4, with their respective feet 32 engaged in the sockets 60 provided in the peripheral region of the base panel 4. Because of the step-like shape of the lower end of the inner side wall panels 16, the side wall panels 16 will be essentially self-supporting, which assists in assembly. It should be noted that a payload may be positioned on the base panel 4 before assembly begins or at a suitable point in the assembly process.

Figure 13B:
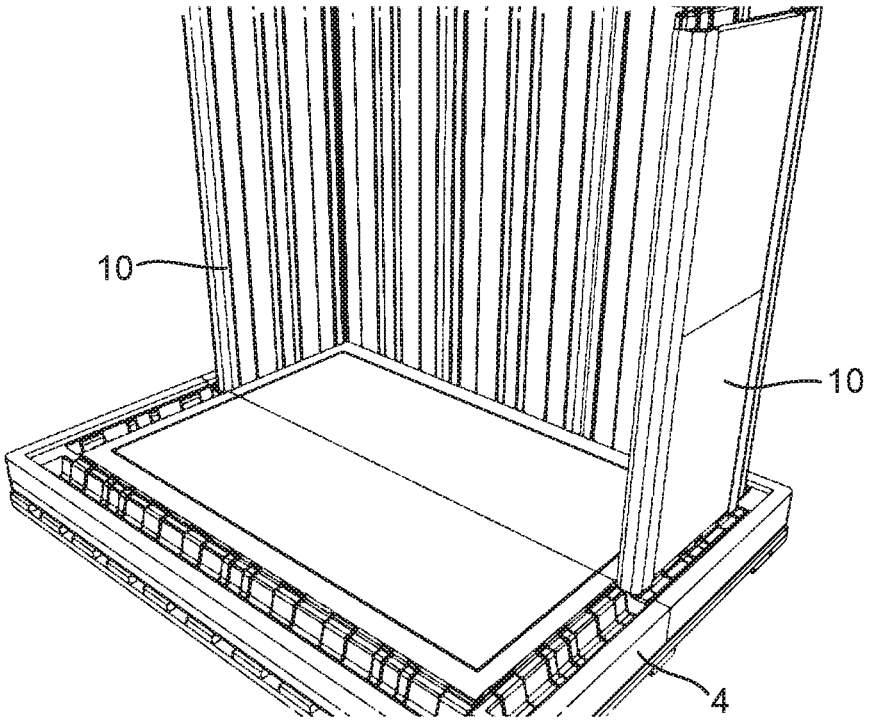
Figure 13C:
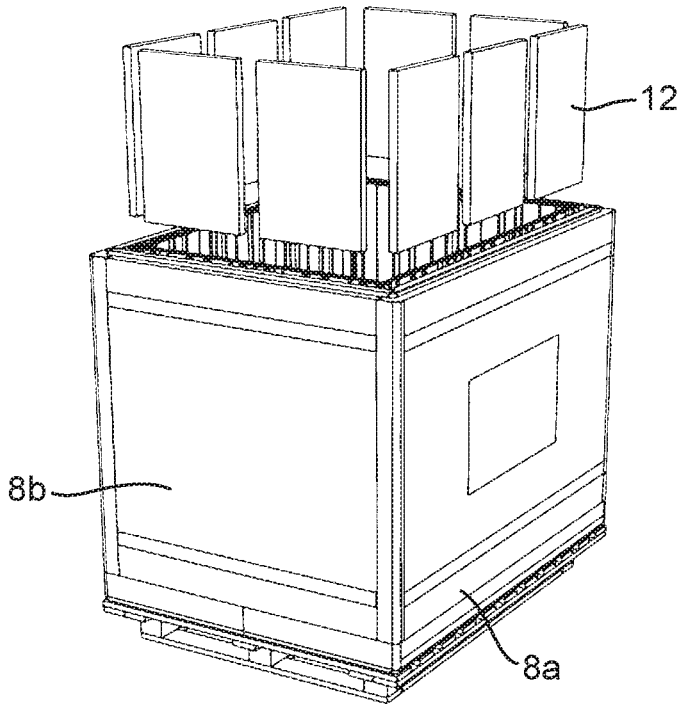
Figure 13D:
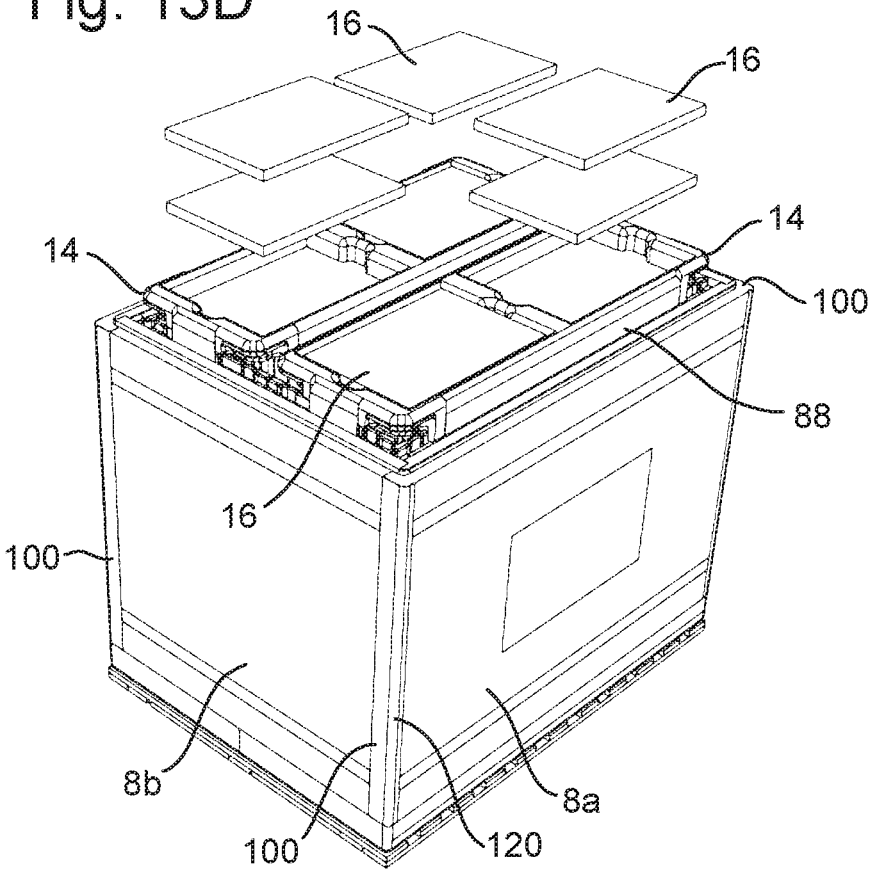

The inner side wall panels 16 are erected around the entire periphery of the base panel 8 as illustrated in FIG. 13*b*. Thereafter, as illustrated in FIG. 13*c*, the outer side wall panels 8*a*, 8*b* are assembled around the inner side wall panels 10, with their lower edges overlapping the feet 32 of the respective inner side wall panels 10 as discussed above. This lends additional stability to the side walls during assembly.

Then, as illustrated in FIG. 13*d*, the thermal conditioning elements 12 may be dropped into the channels 26 of the respective inner side wall panels 10. In this embodiment, each side wall panel accommodates two thermal conditioning elements 12. The thermal conditioning elements 12 may comprise any suitable thermal conditioning material, depending on the particular nature of the payload being transported. For example, the elements may be blocks or bricks containing water or other coolants, for example phase change materials. The invention is not limited to the use of any particular thermal conditioning material, nor to the number or shape of the thermal conditioning elements 12 received in the channels 26.

Once the thermal conditioning elements 12 have been inserted into the channels 26 of the inner side wall panels 16, the top inner panels 14 may be located over the upper ends of the inner side wall panels 16, the upper ends being received in the channel 92 of each top inner panel 14. This firmly locks the upper ends of the inner side wall panels 16 together and in effect closes the top of each channel 26.

Once the top panels 14 are in position, thermal conditioning elements 16 (which may be of the same or of a different construction from the thermal conditioning elements 12 arranged in the inner side wall panels 10) are inserted into the compartments 74 in the tray body 76. Once the thermal conditioning elements 16 are in position, the lid 20 may be positioned over upper ends of the outer side wall panels 12 in order to close the container. In order to secure the container, straps may be wrapped around the container. To this end, corners or edges of the outer side walls 8 and lid 20 may be provided with protection elements 120, for example plastics or other strips, suitably attached to the corners or edges in the desired positions.

In an alternative arrangement, the thermal conditioning elements 12 may be preloaded into the inner side wall panels 14. This is illustrated in FIG. 14. The thermal conditioning elements 16 may be also be preloaded into the top panels 14 as illustrated.

An advantage of the inner side wall panels 10 as disclosed is that they may be stacked adjacent one another, for example as illustrated in FIGS. 15*a* and 15*b*. The design of the panel allows a distal portion of each foot 32 to engage under the platform 34 of an adjacent inner side wall panel 10 as illustrated. Moreover, the thermal conditioning elements 18 may be preconditioned in the inner side wall panels 16, in the stacked configuration. In this regard, as can be seen best in FIG. 15*b*, the respective grooves 50, 54 formed in the respective faces of the inner side wall panels 10 will allow air to circulate in front of and behind a thermal conditioning element 12 retained in the inner side wall panel 10 which will allow the thermal conditioning element 10 to be thermally conditioned more quickly.

The inner side wall panels 10 may also be stacked in a rack 130, as illustrated in FIG. 16. The rack 130 may be made from any suitable material, for example a moulded plastics material. The rack is provided with a series of sockets 132 for receiving the panels 10 adjacent one another. The panels 10 will be spaced from one another which may improve the thermal conditioning of the elements 12 therein.

It will be understood that the above description is simply of one embodiment of the invention and various modifications may be made thereto without departing from the scope of the invention. For example, the design lends itself to adaptation to different sizes of container. For example, FIG. 17 illustrates a different shape of container 202 having two outer side wall panels 8*b* in place of the single outer side wall panel 8*b* of the first embodiment. Internally, there will be six internal side wall panels extending along the longer wall of the container 202, with four top panels. In addition, the lid 214 comprises a central lid portion 214*a* and two side portions 214*b* which are connected to the central portion through respective hinges 214*c*.

It will also be understood that the design of the present invention allows the contents of the container 2 to be inspected without disassembly of the whole container. In particular, as illustrated in FIG. 11, one lid part 20*a* may be pivoted back over another lid part 20*b* in order to create an opening in the top of the container. This opening is positioned and as such a size to allow the underlying top panel 14 to be removed through the opening so that the contents of the container 2 can be inspected. Once inspected, the panel 14 and lid part 20*b* may be replaced.

In this embodiment, all the panels 4, 8, 10 and the lid 20 are formed from a thermally insulating material, such as an expanded foam material, such as expanded polystyrene, for example Neopor®, although the invention is not limited to these particular materials.

Also, in other embodiments, multiple channels may be provided in an or each inner side wall panel 10. For example the channel panel may be formed with one or more intermediate longitudinal ribs, with additional retaining elements attached to those ribs to retain the thermal conditioning elements.

The invention claimed is:

1. A thermal conditioning wall panel for use in a thermally insulating container, comprising: a panel body; the body having a channel formed therein along one face of the body for receiving one or more thermal conditioning elements, and at least one foot formed at the lower end of the body for engagement within a socket provided on the thermally insulating container; the panel further comprising thermal conditioning element retaining elements provided adjacent the longitudinal edges of the channel, said retaining elements projecting over a peripheral portion of the channel and extending at least partially around longitudinal edges of the body for retaining the thermal conditioning elements within the channel.

2. A panel as claimed in claim 1, wherein the panel body is of a thermally insulating material.

3. A panel as claimed in claim 1 wherein a lower end of the channel is at least partially closed.

4. A panel as claimed in claim 3, wherein the lower end of the channel is fully closed.

5. A panel as claimed in claim 1, wherein the thermal conditioning element retaining elements are separate elements attached to the body.

6. A panel as claimed in claim 1, wherein the retaining elements are generally C shaped in section, extending around the edges of the body.

7. A panel as claimed in claim 1, wherein the retaining elements are resilient.

8. A panel as claimed in claim 1, wherein the foot extends across substantially the entire lower end of the body.

9. A panel as claimed in claim 1, wherein the foot projects away from at least one face of the body.

10. A panel as claimed in claim 9, wherein the foot extends away from the face of the body having the channel.

11. A panel as claimed in claim 1, wherein the foot is generally trapezoidal in shape.

12. A panel as claimed in claim 1, wherein the foot extends over only a partial thickness of the body.

13. A panel as claimed in claim 12, wherein the lower end of the body forms a step.

14. A panel as claimed in claim 13, wherein the step is generally perpendicular to an adjacent face of the panel.

15. A panel as claimed in claim 1, wherein the foot is provided with one or more locators for locating the panel in the base socket.

16. A thermally insulated container comprising a base panel having a plurality of sockets arranged around a periphery thereof, and one or more panels as claimed in claim 1 received therein.

17. A container as claimed in claim 16, further comprising a plurality of outer side wall panels of a thermally insulating material mounted to the base panel outwardly of the thermally conditioning wall panels.

18. A thermal conditioning wall panel for use in a thermally insulating container, comprising: a panel body; the body having a channel formed therein along one face of the body for receiving one or more thermal conditioning elements, and at least one foot formed at the lower end of the body for engagement within a socket provided on the thermally insulating container; the panel further comprising thermal conditioning element retaining elements provided adjacent the longitudinal edges of the channel, said retaining elements projecting over a peripheral portion of the channel for retaining the thermal conditioning elements within the channel, and a reinforcing cap mounted to the lower end of at least one longitudinal edge of the body so as to extend inwardly over a portion of the foot and upwardly over at least a lower portion of the longitudinal edge.

19. A panel as claimed in claim 18, wherein the panel body is of a thermally insulating material.

20. A panel as claimed in claim 18, wherein the lower end of the channel is fully closed.

21. A panel as claimed in claim 18, wherein the retaining elements are resilient.

22. A panel as claimed in claim 18, wherein the foot extends across substantially the entire lower end of the body.

23. A panel as claimed in claim 18, wherein the foot extends away from the face of the body having the channel.

24. A panel as claimed in claim 18, wherein the foot is generally trapezoidal in shape.

25. A thermally insulated container comprising a base panel having a plurality of sockets arranged around a periphery thereof, and one or more panels as claimed in claim 18 received therein.

26. A container as claimed in claim 25, further comprising a plurality of outer side wall panels of a thermally insulating material mounted to the base panel outwardly of the thermally conditioning wall panels.

27. A thermal conditioning wall panel for use in a thermally insulating container, comprising: a panel body; the body having a channel formed therein along one face of the body for receiving one or more thermal conditioning elements wherein the face of the channel receiving the thermal conditioning elements is provided with one or more longitudinal grooves, and at least one foot formed at the lower end of the body for engagement within a socket provided on the thermally insulating container; the panel further comprising thermal conditioning element retaining elements provided adjacent the longitudinal edges of the channel, said retaining elements projecting over a peripheral portion of the channel for retaining the thermal conditioning elements within the channel.

28. A panel as claimed in claim 27, wherein the panel body is of a thermally insulating material.

29. A panel as claimed in claim 27, wherein the lower end of the channel is fully closed.

30. A panel as claimed in claim 27, wherein the retaining elements are resilient.

31. A panel as claimed in claim 27, wherein the foot extends across substantially the entire lower end of the body.

32. A panel as claimed in claim 27, wherein the foot extends away from the face of the body having the channel.

33. A panel as claimed in claim 27, wherein the foot is generally trapezoidal in shape.

34. A thermally insulated container comprising a base panel having a plurality of sockets arranged around a periphery thereof, and one or more panels as claimed in claim 27 received therein.

35. A container as claimed in claim 34, further comprising a plurality of outer side wall panels of a thermally insulating material mounted to the base panel outwardly of the thermally conditioning wall panels.

36. A thermal conditioning wall panel for use in a thermally insulating container, comprising: a panel body; the body having a channel formed therein along one face of the body for receiving one or more thermal conditioning elements, and one or more longitudinal grooves formed therein along the face of the panel body opposite the channel, and at least one foot formed at the lower end of the body for engagement within a socket provided on the thermally insulating container; the panel further comprising thermal conditioning element retaining elements provided adjacent the longitudinal edges of the channel, said retaining elements projecting over a peripheral portion of the channel for retaining the thermal conditioning elements within the channel.

37. A panel as claimed in claim 36, wherein the panel body is of a thermally insulating material.

38. A panel as claimed in claim 36, wherein the lower end of the channel is fully closed.

39. A panel as claimed in claim 36, wherein the retaining elements are resilient.

40. A panel as claimed in claim 36, wherein the foot extends across substantially the entire lower end of the body.

41. A panel as claimed in claim 36, wherein the foot extends away from the face of the body having the channel.

42. A panel as claimed in claim 36, wherein the foot is generally trapezoidal in shape.

43. A thermally insulated container comprising a base panel having a plurality of sockets arranged around a periphery thereof, and one or more panels as claimed in claim 36 received therein.

44. A container as claimed in claim 43, further comprising a plurality of outer side wall panels of a thermally insulating material mounted to the base panel outwardly of the thermally conditioning wall panels.

* * * * *